US007222375B2

(12) United States Patent
Chen et al.

(10) Patent No.: US 7,222,375 B2
(45) Date of Patent: May 29, 2007

(54) TANK BALL ASSEMBLY FOR TOILET

(76) Inventors: Po-Hsin Chen, No. 121, Chienchung St., East Dist., Taichung City (TW); Guan-Chung Chen, No. 121, Chienchung St., East Dist., Taichung City (TW)

( * ) Notice: Subject to any disclaimer, the term of this patent is extended or adjusted under 35 U.S.C. 154(b) by 256 days.

(21) Appl. No.: 11/098,750

(22) Filed: Apr. 5, 2005

(65) Prior Publication Data

US 2006/0218713 A1 Oct. 5, 2006

(51) Int. Cl.
*E03D 1/35* (2006.01)

(52) U.S. Cl. ..... 4/404

(58) Field of Classification Search ..... 4/392–393, 4/395, 403–404

See application file for complete search history.

(56) References Cited

U.S. PATENT DOCUMENTS

| | | | | |
|---|---|---|---|---|
| 4,497,076 | A * | 2/1985 | Sullivan | 4/392 |
| 4,872,473 | A * | 10/1989 | Agostino | 137/270 |
| 5,182,819 | A * | 2/1993 | Shaw | 4/393 |
| 6,381,765 | B1 * | 5/2002 | Liu | 4/404 |
| 2003/0213054 | A1 * | 11/2003 | Huang | 4/395 |

* cited by examiner

*Primary Examiner*—Charles E. Phillips
(74) *Attorney, Agent, or Firm*—Rosenberg, Klein & Lee

(57) ABSTRACT

A tank ball assembly is disclosed to include a cover stopper mounted with a gasket for closing the drain port of the tank of a toilet, a tank ball coupled to an upright short tubular flange of the cover stopper and rotatable on the upright short tubular flange to adjust the angular position of the air outlet thereof and to further adjust the flushing amount of tank water, and an adjustment screw fastened to a post at the cover stopper and adjustable to approach to the water inlet of the tank ball and to further adjust the flowing rate of tank water into the tank ball.

1 Claim, 5 Drawing Sheets

TANK BALL ASSEMBLY FOR TOILET

BACKGROUND OF THE INVENTION

1. Field of the Invention

The present invention relates to a toilet and more particularly, to a tank ball assembly for toilet that can be adjusted to control the flushing amount of tank water for flushing urine.

2. Description of the Related Art

FIGS. 1A and 1B show a prior art tank ball assembly and the use of the tank ball assembly in the tank of a toilet. As illustrated, the tank ball assembly comprises a cover stopper 1, a tank ball 2 formed integral with the cover stopper 1, and a gasket 3 fixedly fastened to the top wall of the cover stopper 1 around the tank ball 2. When installed in the tank 4 of a toilet, the cover stopper 1 with the gasket 3 stop the passage of the drain port 6 of the tank 4. When lifted the trip lever 5 of the tank 4, the tank ball assembly is floating in tank water, and tank water runs out of the tank 4 through the drain port 6 in a rush. At the same time, the tank ball 2 is lowered with the water level till that the cover stopper 1 and the gasket 3 are stopped at the drain port 6 again. This design of tank ball assembly is functional, however it does not adjustment of flushing amount of tank water.

SUMMARY OF THE INVENTION

The present invention has been accomplished under the circumstances in view. It is the main object of the present invention to provide a tank ball assembly for toilet, which allows adjustment of flushing amount of tank water. According to one aspect of the present invention, the that tank ball assembly comprises a cover stopper mounted with a gasket for closing the drain port of the tank of a toilet, and a tank ball coupled to an upright short tubular flange of the cover stopper. The tank ball has a water inlet at the top center, and an air outlet at one lateral side. The user can rotate the tank ball on the upright short tubular flange of the cover stopper to adjust the angular position of the air outlet so as to adjust the flushing amount of tank water. According to another aspect of the present invention, an adjustment screw is threaded into a screw hole at the top side of a post at the cover stopper. The user can adjust the elevation of the adjustment screw so as to further adjust the flowing rate of tank water into the tank ball.

DETAILED DESCRIPTION OF THE PREFERRED EMBODIMENT

Figure 1A:
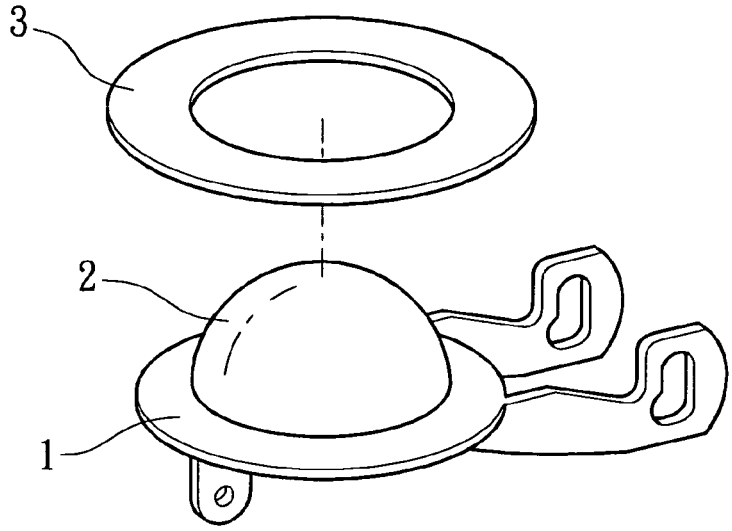
PRIOR ART FIG. 1A
FIG. 1A is an exploded view of a tank ball assembly according to the prior art.
Figure 1B:
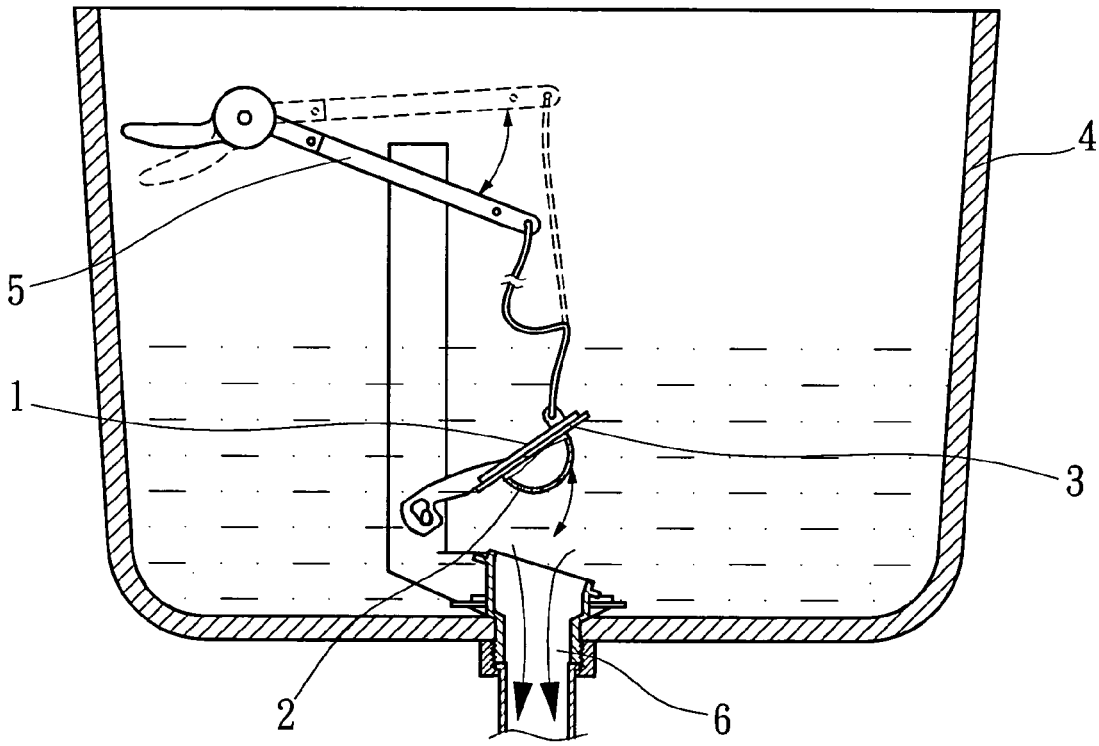
PRIOR ART FIG. 1B
FIG. 1B is a schematic sectional view showing the use of the prior art tank ball assembly in the tank of a toilet.
Figure 2:
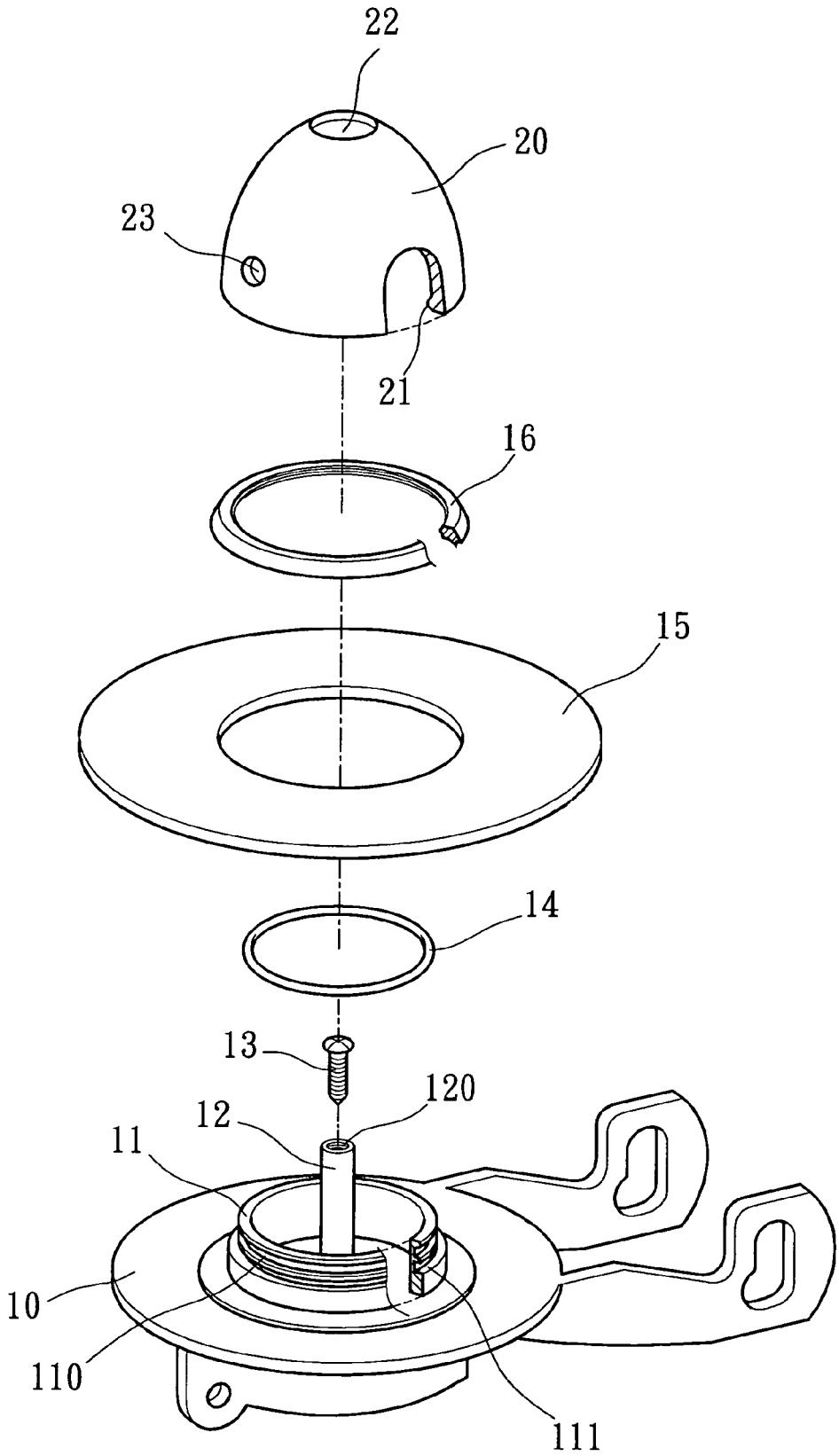
FIG. 2 is an exploded view of a tank ball assembly according to the present invention.

Referring to FIGS. 2~4, a tank ball assembly in accordance with the present invention is shown comprised of a cover stopper 10, a gasket 15, and a tank ball 20. The cover stopper 10 comprises a post 12 vertically upwardly extending from the top wall at the center, and a short tubular flange 11 upwardly protruded from the top wall around the post 12. The post 12 has a screw hole 120 at the top. An adjustment screw 13 is threaded into the screw hole 120. The short tubular flange 11 has a first annular groove 110 and a second annular groove 111 extending around the periphery at different elevations. The gasket 15 is attached to the top wall of the cover stopper 10 around the short tubular flange 11 and secured thereto by a retaining ring 16 that is fastened to the first annular groove 110. The tank ball 20 is capped on the short tubular flange 11 of the cover stopper 10 and pressed on the retaining ring 16 against the gasket 15, having a bottom coupling flange 21 coupled to the second annular groove 111 of the short tubular flange 11 of the cover stopper 10, a water inlet 22 at the center, and an air outlet 23 at one lateral side. The diameter of the water inlet 22 is greater than the air outlet 23.

Figure 4A:
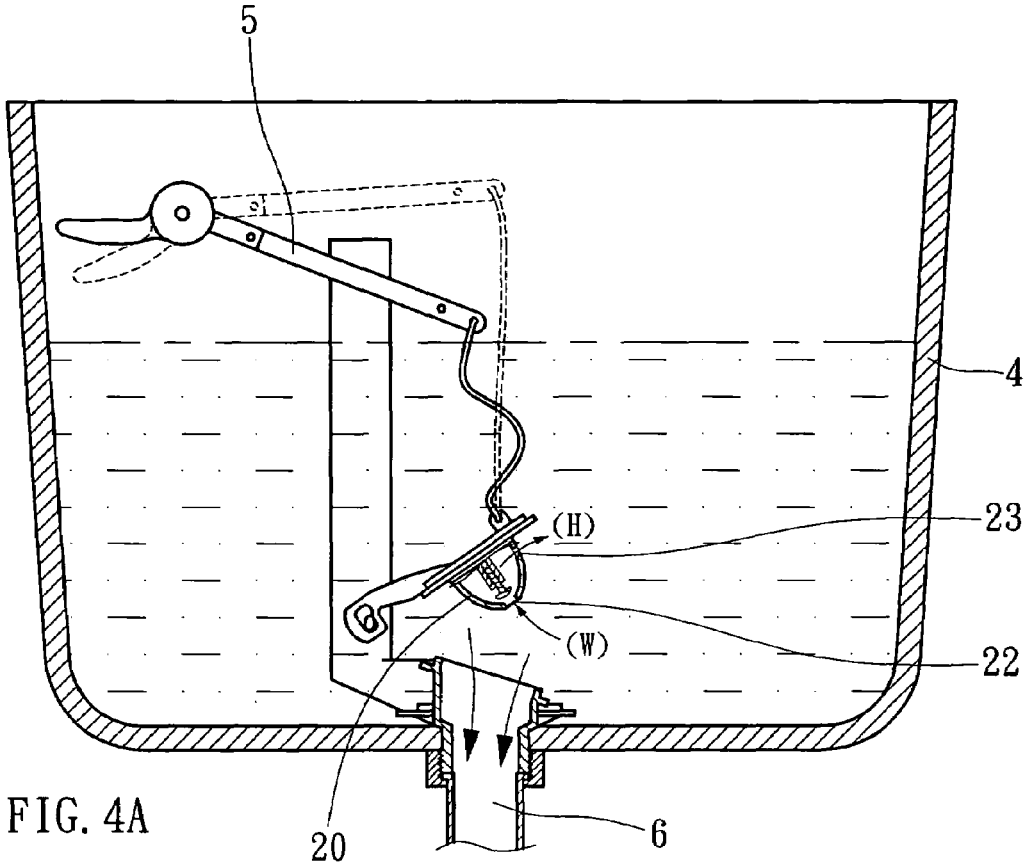
FIG. 4A is a schematic applied view of the present invention, showing the tank ball assembly opened from the drain port of the tank.
Figure 4B:
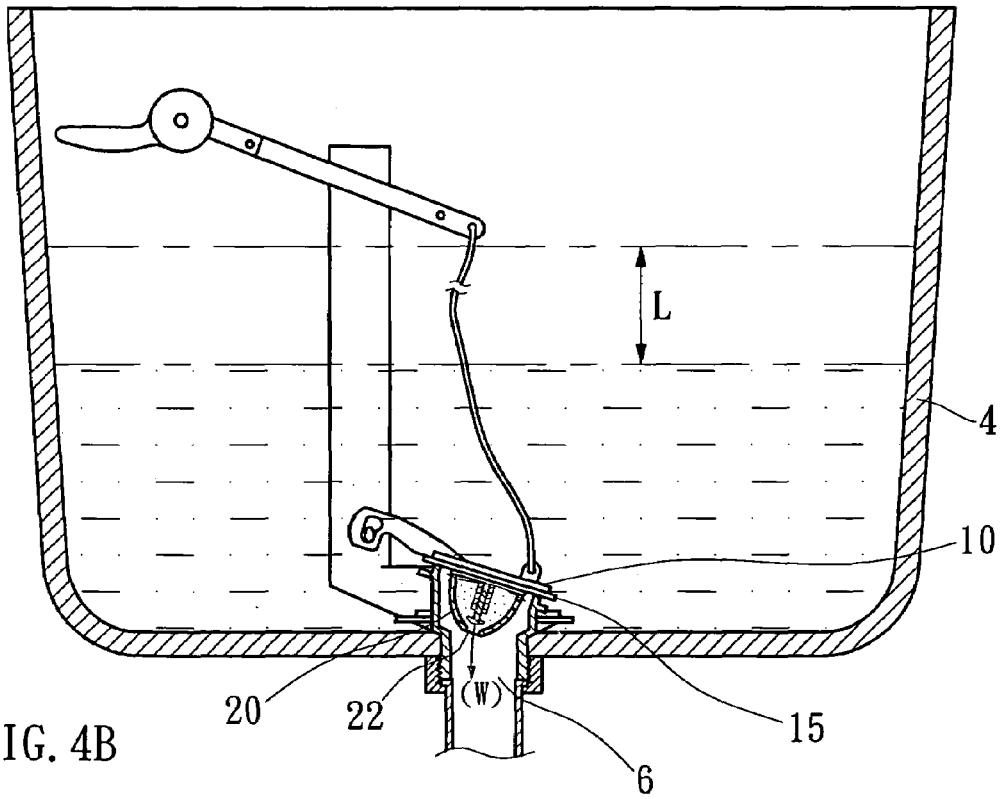
FIG. 4B is a schematic applied view of the present invention, showing the tank ball assembly stopped the drain port of the tank.

After installation of the tank ball assembly in the tank 4 of a toilet as shown in FIG. 4B, the cover stopper 10 with the gasket 15 and the tank ball 20 close the drain port 6 of the tank 4. When biased the flush handle to turn the trip lever 5 upwards, the tank ball assembly is lifted from the drain port 6, allowing tank water W to flush out of the tank 4 through the drain port 6 as sown in FIG. 4A. At this time, the tank ball 20 is dipped in tank water W, and tank water W passes through the water inlet 22 into the inside of the tank ball 20 to expel air H out of the tank ball 20 through the air outlet 23. When the tank ball 20 has been filled up with tank water W, the pressure of tank water W in the tank ball 20 forces the tank ball 20 downwards, and therefore the tank ball assembly is lowered to the drain port 6 to stop the passage again. During water filling stroke of the tank ball 20, the tank ball 20 is floating in tank water W and the drain port 6 is opened for letting out tank water W. Within the time where tank water W is filling into the tank ball 20, an amount of tank water W equal to the volume (height or depth) L shown in FIG. 4B is discharged out of the tank 4. The volume L of tank water W is used to flush urine. When flushing stool, a relatively greater amount of flushing water is required. At this time, the user can hold the trip lever 5 in the lifted position for a relatively longer period of time, enabling tank water W to continuously run out of the tank 4 through the drain port 6 to clean the waste passage of the toilet.

Figures 5A, 5B, 5C:
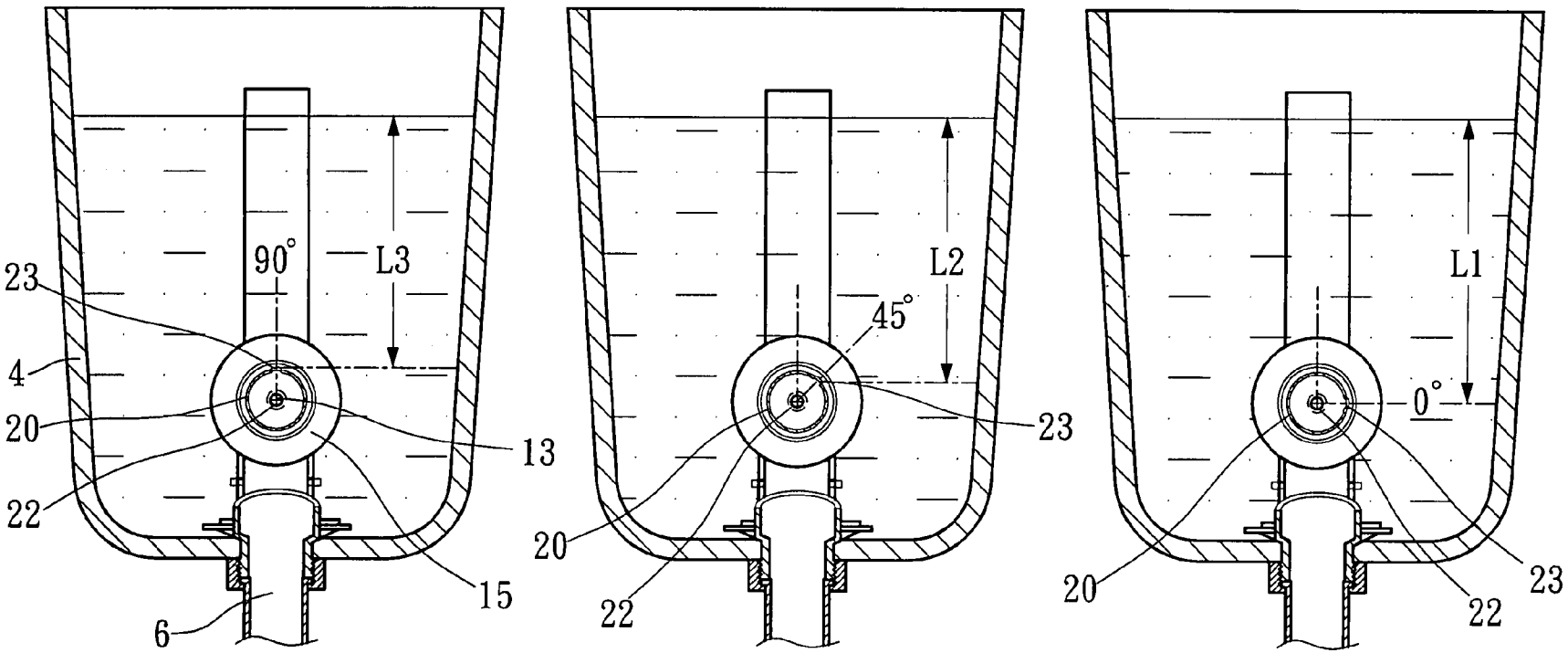
FIG. 5A is a schematic drawing of the present invention, showing the air outlet of the tank ball in the 90° position.
FIG. 5B is a schematic drawing of the present invention, showing the air outlet of the tank ball in the 40° position.
FIG. 5C is a schematic drawing of the present invention, showing the air outlet of the tank ball in the 0° position.

Further, the user can adjust the volume L of tank water W for flushing urine in either of two ways. The first way is to change the angular position of the air outlet 23 of the tank ball 20, i.e., the tank ball 20 can be rotated on the short tubular flange 11 of the cover stopper 10 to the first position where the air outlet 23 is in the 90° position as shown in FIG. 5A, the second position where the air outlet 23 is in the 45° position as shown in FIG. 5B, or the third position where the air outlet 23 is in the 0° position as shown in FIG. 5C. Subject to COS θ theory, when the air outlet 23 is in the 90° position as shown in FIG. 5A, COS90°=0, therefore the speed of tank water W passing through the water inlet 22 into the tank ball 20 and the speed of air H passing through the air outlet 23 out of the tank ball 20 are the fastest; when the air outlet 23 is in the 45° position as shown in FIG. 5B, COS45°=0.7, therefore it requires a relatively longer period of time than in the 90° position to have the tank ball 20 be fully filled up with tank water W; when the air outlet 23 is in the 0° position as shown in FIG. 5C, COS0°=1, therefore it requires more longer period of time than in 90° position and in 45° position to have the tank ball 20 be fully filled up with tank water W. When in the 90° position, the air outlet 23 is at a first level L1. When in the 45° position, the air outlet 23 is at a second level L2 below the first level L1. When in the 0° position, the air outlet 23 is in a third level L3 below the second level L2. Therefore, by means of changing the angular position of the air outlet 23, the flushing amount of tank water W is relatively adjusted.

Figure 3A:
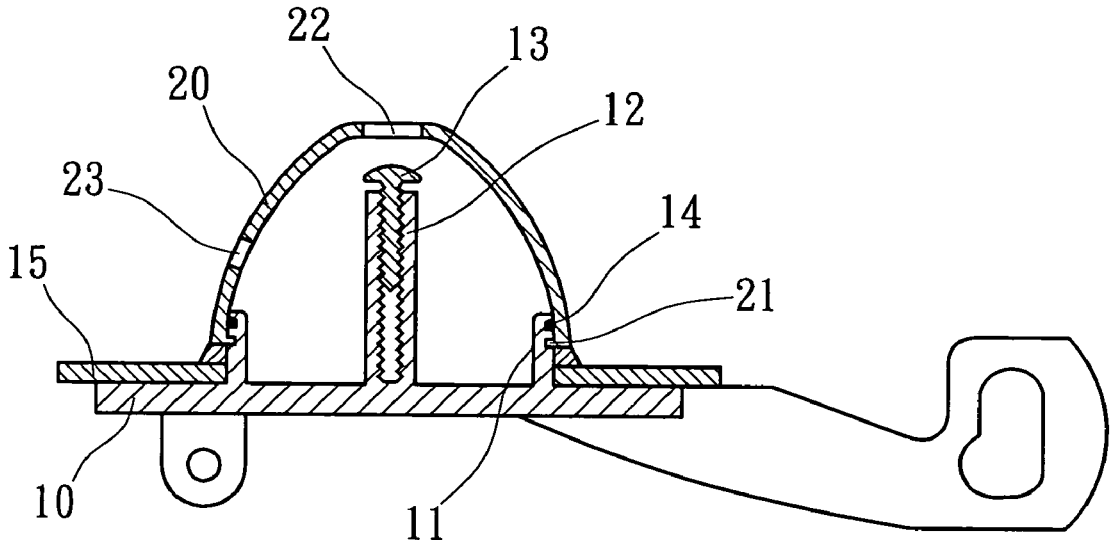
FIG. 3A is a sectional assembly view of the present invention, showing one position of the adjustment screw in the post of the cover stopper of the tank ball assembly.
Figure 3B:
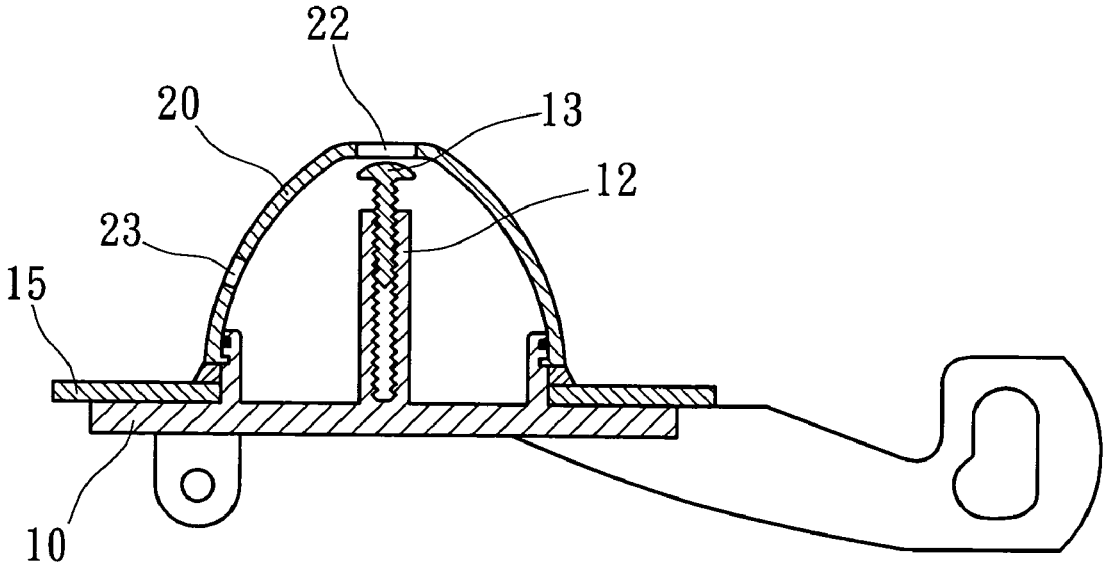
FIG. 3B is similar to FIG. 3A but showing the position of the adjustment screw adjusted.

The second way to adjust the volume L of tank water W for flushing urine is to adjust the elevational position of the adjustment screw 13 in the screw hole 120 of the post 12 as shown in FIGS. 3A and 3B. When adjusted the adjustment screw 13 to a relatively higher position as shown in FIG. 3B, the adjustment screw 13 detains the flowing of tank water W into the tank ball 20. On the contrary, adjusting the adjustment screw 13 to a relatively lower position as shown in FIG. 3A, the adjustment screw 13 will not hinder the flowing of tank water W into the tank ball 20, and therefore the tank ball 20 can be filled up with tank water W within a relatively shorter period of time.

A prototype of tank ball assembly has been constructed with the features of FIGS. 2~5. The tank ball assembly functions smoothly to provide all the features discussed earlier.

Although a particular embodiment of the invention has been described in detail for purposes of illustration, various modifications and enhancements may be made without departing from the spirit and scope of the invention, for example, the tank ball 20 and the cover stopper 10 can be made in integrity and the water inlet 22 and the air outlet 23 can be made after formation of the tank ball 20 with the cover stopper 10. Accordingly, the invention is not to be limited except as by the appended claims.

What the invention claimed is:

1. A tank ball assembly comprising:

a cover stopper, said cover stopper comprising a top wall, a post vertically upwardly extending from the top wall, said post having a top screw hole, an adjustment screw threaded into said top screw hole, a short tubular flange upwardly protruded from the top wall around said post, and a first annular groove and second annular groove extending around the periphery of said short tubular flange at different elevations;

a gasket attached to the top wall of said cover stopper around said short tubular flange;

a retaining ring fastened to the first annular groove of said cover stopper to secure said gasket to said cover stopper; and a tank ball capped on said short tubular flange of said cover stopper and rotatable on said short tubular flange, said tank ball having a bottom coupling flange coupled to the second annular groove of said cover stopper, a water inlet at a top center thereof and an air outlet at one lateral side thereof, said water inlet having a diameter greater than said air outlet.

* * * * *